US007160230B2

(12) United States Patent
Tremblay

(10) Patent No.: US 7,160,230 B2
(45) Date of Patent: Jan. 9, 2007

(54) MECHANISM FOR SYNCHRONIZING THE MOVEMENT OF THE HANDLEBARS OF AN EXERCISE APPARATUS

(75) Inventor: Jess Tremblay, St-Fulgence (CA)

(73) Assignee: Bodyguard Fitness, St-Georges (CA)

( * ) Notice: Subject to any disclaimer, the term of this patent is extended or adjusted under 35 U.S.C. 154(b) by 437 days.

(21) Appl. No.: 10/621,573

(22) Filed: Jul. 18, 2003

(65) Prior Publication Data

US 2004/0082440 A1 Apr. 29, 2004

(30) Foreign Application Priority Data

Jul. 19, 2002 (CA) ..... 2394249

(51) Int. Cl.
*A63B 22/06* (2006.01)
*A63B 21/00* (2006.01)

(52) U.S. Cl. ..... 482/52; 482/62

(58) Field of Classification Search ..... 482/51–53, 482/57, 62, 70–71, 59; 601/36
See application file for complete search history.

(56) References Cited

U.S. PATENT DOCUMENTS 3,213,852 A * 10/1965 Zent ..... 601/36
3,966,201 A * 6/1976 Mester ..... 482/72
4,757,988 A * 7/1988 Szymski ..... 482/59
4,824,102 A 4/1989 Lo
4,902,001 A 2/1990 Balbo
5,163,888 A 11/1992 Stearns
5,241,179 A * 8/1993 Carrieri ..... 250/341.6
5,397,286 A * 3/1995 Chang ..... 482/62
5,407,409 A 4/1995 Tang
5,431,614 A * 7/1995 Jeranson ..... 482/57
5,501,648 A 3/1996 Grigoriev
5,709,633 A * 1/1998 Sokol ..... 482/62
5,836,856 A 11/1998 Mattoo et al.
6,045,487 A 4/2000 Miller
6,132,341 A * 10/2000 Lin ..... 482/57
6,220,991 B1 * 4/2001 Sellers ..... 482/62
6,328,677 B1 12/2001 Drapeau

* cited by examiner

*Primary Examiner*—Stephen R. Crow
(74) *Attorney, Agent, or Firm*—Ogilvy Renault LLP

(57) ABSTRACT

A system for use in an exercise apparatus for synchronizing the movement of the upper limbs comprises a shaft mounted for rotation about its longitudinal axis, left and right pulleys mounted at opposed end portions of the shaft, and left and right handlebars respectively connected to the left and right pulleys and pivotable therewith about the longitudinal axis of the shaft. Left and right one-way clutches are provided for respectively transmitting a torque from the left and right pulleys to the shaft in one direction, while allowing the left and right pulleys to rotate freely relative to the shaft when driven in an opposite direction. First and second cables are connected in parallel between the left and right pulleys to communicate a movement imparted to one of the pulleys to the other pulley but in an opposite direction, thereby causing the handlebars to pivot in an inverted synchronized fashion.

11 Claims, 2 Drawing Sheets

MECHANISM FOR SYNCHRONIZING THE MOVEMENT OF THE HANDLEBARS OF AN EXERCISE APPARATUS

BACKGROUND OF THE INVENTION

1. Field of the Invention

The present invention relates to exercise apparatuses and, more particularly, to a mechanism for synchronizing the movement of the handlebars of an exercise apparatus.

2. Description of the Prior Art

Exercisers wherein the arms of the user act in alternating fashion to drive an energy absorbing wheel or the like are well known. For instance, U.S. Pat. No. 4,902,001 issued on Feb. 20, 1990 to Balbo discloses a cycle exerciser including a pair of pivotable arm levers that can be operated in a reciprocating fashion for propelling an energy-absorbing wheel. The motion of the lever arms is synchronized with the motions of the pedals.

It has been found that there is a need for a new exerciser wherein the movement of the user's arms is synchronized independently of the user's legs.

SUMMARY OF THE INVENTION

It is therefore an aim of the present invention to provide a new upper body's synchronous system which can be used to exercise the arms and the upper torso of the user.

It is also an aim of the present invention to provide a synchronizing mechanism which is of simple construction.

Therefore, in accordance with the present invention, there is provided a mechanism for synchronizing the movement of first and second pivotable handlebars of an exercise apparatus, the mechanism comprising first and second pulleys mounted at opposed end portions of a shaft that is mounted for rotation about a longitudinal axis thereof, said first and second pulleys being respectively connected to receive rotational drive from the first and second handlebars, first and second one-way clutches for respectively transmitting a torque from said first and second pulleys to said shaft in one direction, while allowing said first and second pulleys to rotate freely on said shaft when driven in an opposite direction, and a drive transmission between said first and second pulleys to communicate a movement imparted to one of said first and second pulleys to the other pulley but in an opposite direction, thereby causing the handlebars to pivot in an inverted synchronized fashion.

In accordance with a further general aspect of the present invention, there is provided an exercise apparatus comprising a system for synchronizing the movement of a pair of limbs, comprising a shaft mounted for rotation about a longitudinal axis thereof, left and right pulleys mounted at opposed end portions of said shaft, left and right exercise members respectively connected to said left and right pulleys and pivotable therewith about said longitudinal axis, left and right one-way clutches for respectively transmitting a torque from said left and right pulleys to said shaft in one direction, while allowing said left and right pulleys to rotate freely relative to said shaft when driven in an opposite direction, and a pair of elongated transmission members connected in parallel between said left and right pulleys on opposite sides of said shaft.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
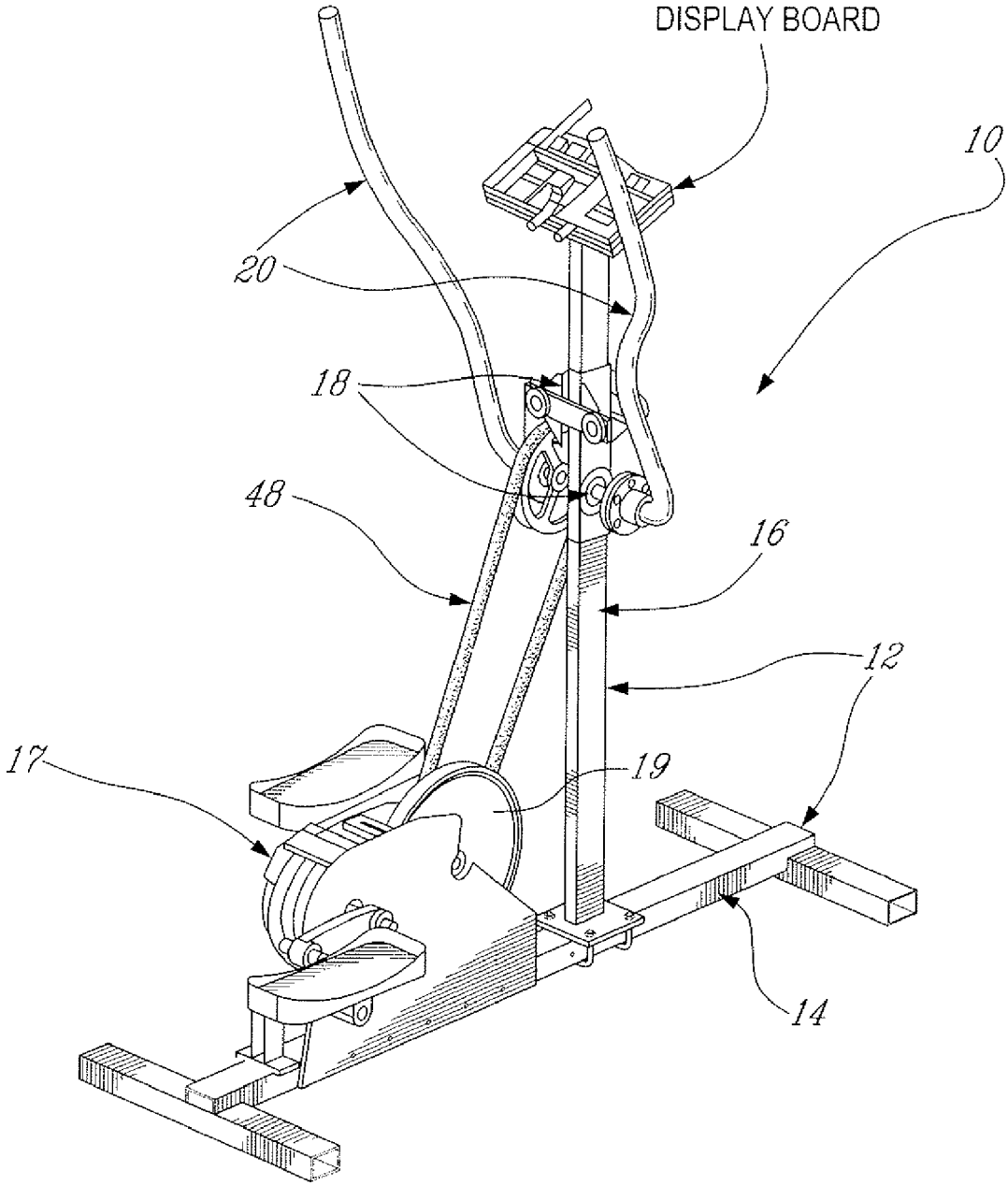
FIG. 1 is a perspective view of an exercise apparatus having a pair of synchronized pivotable handlebars in accordance with a preferred embodiment of the present invention.

Now referring to the drawings, FIG. 1 illustrates an exercise apparatus 10 comprising a frame 12 having a base 14 and a main upright tubular member 16 which supports an upper body's synchronous system 18 forming part of the present invention. It is noted that the synchronous system 18 of the present invention can be attached to any exerciser, such as an elliptic exerciser or a stationary exercise bicycle.

According to the illustrated example, the frame 12 also carries an elliptical mechanism 17 that can be powered by feet for driving a rotatable energy-absorbing wheel 19. Resistance to wheel movement can be achieved through any conventional mechanical, magnetic, hydraulic or pneumatic resistance system.

The synchronous system 18 comprises separate left and right reciprocating handlebars 20 mounted for inverted synchronized pivotal movement about a common handlebar axis transversal to the tubular member 16.

Figure 2:
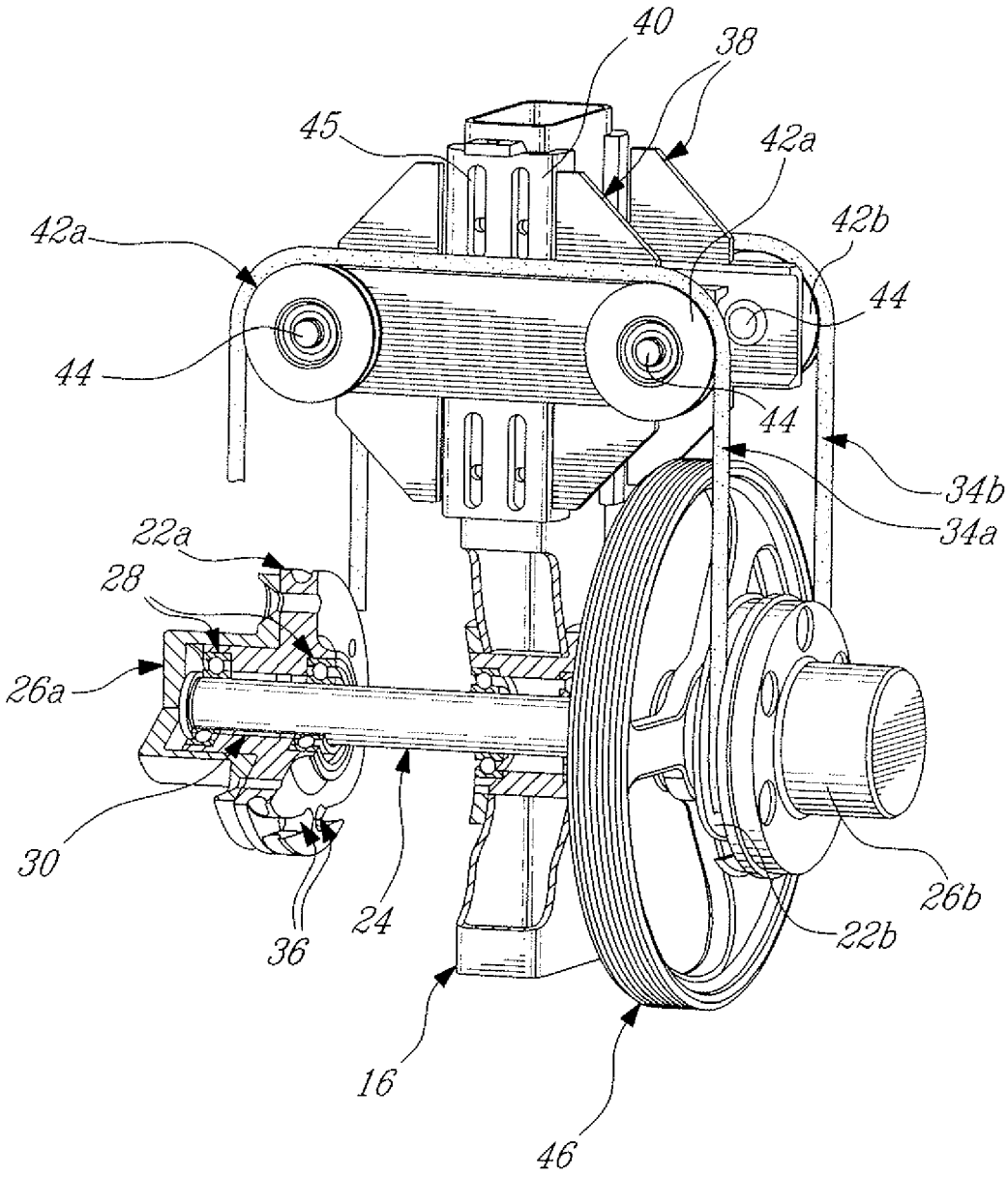
FIG. 2 is an enlarged perspective view of a mechanism for synchronizing the movement of the handlebars of the exercise apparatus shown in FIG. 1.

More particularly, as shown in FIG. 2, the system 18 includes left and right cam pulleys 22*a* and 22*b* mounted at opposed ends of a shaft 24 journaled to the tubular member 16. The lower ends of the handlebars 20 are secured, as by welding, to respective hubs 26*a* and 26*b* which are, in turn, bolted to respective lateral outer faces of the cam pulleys 22*a* and 22*b*. Ball bearings 28 are provided for limiting the axial movement of the cam pulleys 22*a* and 22*b* on the shaft 24. Each pulley 22 has in its core a one-way clutch in the form of a clutch bearing 30 for drivingly connecting the pulley 22 to the shaft 24 in one direction, while allowing the pulley 22 to rotate freely on the shaft 24 in the opposite direction.

A pair of nylon coated steel cables 34*a* and 34*b* are connected in parallel on opposed sides of the cam pulleys 22 so that when one of the cable 34 is drawn downwardly due to the rotational movement of one of the pulley 22, it forces the other pulley 22 to rotate in the opposite direction. The cables 34 ensure joint movement of the cam pulleys 22 but in opposed directions. Each pulley 22 is provided with a pair of cable attachments 36 on opposed sides thereof. The first cable 34*a* is located on a rear facing side of the tubular member 16 and is connected at a first end thereof to the left pulley 22*a* and at a second end thereof to the right pulley 22*b*. The second cable 34*b* is located on a front facing side of the tubular member 16 and is connected at a first end thereof to the left pulley 22*a* and at a second end thereof to the right pulley 22*b*.

A cable tensioner assembly 38 is mounted to the tubular member 16 for maintaining the cables 34 under a desired tension. The cable tensioner assembly 38 includes a support structure 40 carrying rear and front pair of cable pulleys 42*a* and 42*b* mounted on respective laterally spaced-apart idle shafts 44. As shown in FIG. 2, the first cable 34*a* extends over the rear cable pulleys 42*a*, whereas the second cable 34*b* extends over the front cable pulleys 42*b*. Elongated slots 45 are defined in the support structure 40 for receiving fasteners in order to adjustably mount the support structure 40 along the tubular member 16.

In operation, when the user pulls on the right handlebar 20 to pivot it rearwardly, the right cam pulley 22*b* rotates in the counterclockwise direction and drives the shaft 24 through the right one-way clutch 30. The pulling action exerted by the right pulley 22*b* on the cable 34*a* causes the left pulley 22*a* to rotate freely relative to the shaft 24 in the clockwise direction, thereby pivoting the left handlebar 20 in the forward direction at the same rotational speed as the right handlebar 20 being pivoted rearwardly. Thereafter, when the user pulls with his/her left arm on the left handlebar 20 to pivot it rearwardly, the left pulley 22*a* rotates in the counterclockwise direction and transmits a torque to the shaft 24 via the left clutch bearing 30. The pulling action exerted by the left pulley 22*a* on the cable 34*a* causes the right pulley 22*b* to rotate in the clockwise direction independently of the shaft 24, thereby pivoting the right handlebar 20 forwardly.

The shaft 24 is, thus, driven in a single direction (the counterclockwise direction in the illustrated embodiment) by the left and right handlebars 20. In fact, the torque is transmitted to the shaft 24, regardless of the action exerted on the right and left handlebars 20. For instance, the pushing action on the right handlebar 20, even though the right clutch bearing 30 rotates freely about the shaft 24, leads the cables 34 to drive the left pulley 22*a* in the opposite direction, thereby causing the left clutch bearing 30 to transmit the torque to the shaft 24. This permits the application of an adjustable opposition to the movement of the shaft 24 in order to vary the effort required to pivot the handlebars 20. For instance, a primary sheave 46 could be keyed to the shaft 24 and engaged with an endless belt 48 (FIG. 1) to transmit a torque from the shaft 24 to a resisting or damping system (not shown) acting on the wheel 19. Alternatively, the handlebars resisting mechanism could be entirely independent of the elliptical mechanism 17. It is also noted that the resisting mechanism does not necessarily have to be mounted on the shaft 24.

The invention claimed is:

1. An exercise apparatus comprising first and second pivotable handlebars, a mechanism for synchronizing the movement of the first and second pivotable handlebars, the mechanism having first and second pulleys mounted at opposed end portions of a shaft that is mounted for rotation about a longitudinal axis thereof, said first and second pulleys being respectively adapted to receive rotational drive from the first and second handlebars, first and second one-way clutches for respectively transmitting a torque from said first and second pulleys to said shaft in one direction, while allowing said first and second pulleys to rotate freely on said shaft when driven in an opposite direction, and a drive transmission between said first and second pulleys to communicate a movement imparted to one of said first and second pulleys to the other pulley but in an opposite direction, thereby causing the handlebars to pivot in an inverted synchronized fashion.

2. An exercise apparatus as defined in claim 1, wherein said drive transmission includes first and second cables connected in parallel between said first and second pulleys.

3. An exercise apparatus as defined in claim 1, wherein each of said first and second one-way clutches includes a clutch bearing.

4. An exercise apparatus as defined in claim 3, wherein said clutch bearings are located at the center of said first and second pulleys.

5. An exercise apparatus as defined in claim 2, wherein a cable tensioner assembly is provided for adjusting the tension in the first and second cables between the pulleys.

6. An exercise apparatus as defined in claim 5, wherein said cable tensioner assembly includes first and second pairs of cable pulleys mounted to a support structure, said first cable running over said first pair of cables pulleys and having opposed ends thereof respectively attached to said first and second pulleys on a first side of said shaft, said second cable running over said second pair of cable pulleys and having opposed ends thereof respectively attached to said first and second pulleys on a second side of said shaft.

7. An exercise apparatus as defined in claim 6, wherein said support structure is adjustable for varying the tension in the first and second cables.

8. An exercise apparatus as defined in claim 1, wherein each of said first and second pulleys includes a cam pulley.

9. An exercise apparatus as defined in claim 1, wherein said shaft is coupled to a resisting mechanism adapted to provide an adjustable opposition to the movement of the shaft in order to vary the effort required to pivot the handlebars.

10. An exercise apparatus as defined in claim 2, wherein said first and second pulleys are each provided on opposed sides thereof with first and second cable attachments.

11. An exercise apparatus as defined in claim 1, wherein said first and second pulleys are each provided with an outer lateral mounting surface adapted to be rigidly connected to a hub.

* * * * *